US005299418A

United States Patent [19]

Kerrebrock

[11] Patent Number: 5,299,418

[45] Date of Patent: Apr. 5, 1994

[54] EVAPORATIVELY COOLED INTERNAL COMBUSTION ENGINE

[75] Inventor: Jack L. Kerrebrock, 108 Tower Rd., Lincoln, Mass. 01773

[73] Assignee: Jack L. Kerrebrock, Lincoln, Mass.

[21] Appl. No.: 895,946

[22] Filed: Jun. 9, 1992

[51] Int. Cl.[5] ..... F02C 3/00

[52] U.S. Cl. ..... 60/39.75; 415/114; 416/96 R

[58] Field of Search ..... 60/39.75; 415/114, 115; 416/96 R, 232

[56] References Cited

U.S. PATENT DOCUMENTS

| | | | |
|---|---|---|---|
| 2,667,326 | 1/1954 | Ledinegg | 253/39 |
| 2,737,366 | 3/1956 | Ledinegg | 253/39 |
| 2,744,723 | 5/1956 | Roush | 416/96 R |
| 2,812,157 | 11/1957 | Turunen et al. | 253/39 |
| 2,849,210 | 8/1958 | Turunen et al. | 253/39 |
| 2,952,441 | 9/1960 | Jones | 253/39 |
| 3,738,771 | 6/1973 | Delarbre et al. | 416/96 X |
| 3,842,596 | 10/1974 | Gray | 60/39 |
| 3,902,820 | 9/1975 | Amos | 416/97 |
| 3,963,368 | 6/1976 | Emmerson | 415/115 |
| 4,022,542 | 5/1977 | Barbeau | 416/97 |
| 4,118,145 | 10/1978 | Stahl | 416/96 |
| 4,179,240 | 12/1979 | Kothman | 416/96 |
| 4,302,153 | 11/1981 | Tubbs | 416/96 |
| 4,314,794 | 2/1982 | Holden et al. | 416/97 |
| 4,330,235 | 5/1982 | Araki | 416/96 |
| 4,422,229 | 12/1983 | Sadler et al. | 29/156 |
| 4,437,810 | 3/1984 | Pearce | 415/115 |
| 4,440,834 | 4/1984 | Aubert et al. | 416/96 R |
| 4,498,301 | 2/1985 | Tsubouchi | 60/657 |
| 4,507,051 | 3/1985 | Lesgourgues et al. | 416/97 |
| 4,522,562 | 6/1985 | Glowacki et al. | 416/95 |
| 4,529,358 | 7/1985 | Papell | 416/97 |
| 4,604,031 | 8/1986 | Moss et al. | 416/97 |
| 4,648,799 | 3/1987 | Brown et al. | 416/95 |
| 4,668,162 | 5/1987 | Cederwall et al. | 415/115 |
| 4,898,514 | 2/1990 | McCracken | 416/95 |

*Primary Examiner*—Richard A. Bertsch
*Assistant Examiner*—Michael F. Kocharov
*Attorney, Agent, or Firm*—Thomas J. Engellenner

[57] ABSTRACT

An evaporatively cooled internal combustion engine includes a compressor, a combustion chamber and a turbine for transmitting work performed by the rapid expansion of combusted working fluid. The turbine includes an arrangement of stators and rotors. Each of the rotors defines an internal cavity which includes a vaporization section which corresponds roughly to the rotor blade and a condensing section which corresponds roughly to the rotor disc. A radial array of circumferentially disposed capture shelves is provided in the vaporization section for capturing cooling fluid contained within the internal cavity and flowing radially outwardly in a centrifugal field generated during rotation of the rotor. The capture shelves restrict the flow of the cooling fluid to distribute the fluid over the inner surface of the rotor in the vaporization section.

9 Claims, 1 Drawing Sheet

EVAPORATIVELY COOLED INTERNAL COMBUSTION ENGINE

BACKGROUND OF THE INVENTION

The invention relates generally to the field of power systems. In particular, the invention concerns an evaporatively cooled rotor for a gas turbine.

Internal combustion engines, such as gas turbine engines, utilize a working fluid that at all times remains gaseous. During combustion, however, the working fluid does change its composition, from air and fuel to combustion products. The stochiometric optimal temperature for effecting this change is in the neighborhood of 4000 degrees Farenheit.

A conventional gas turbine engine includes a compressor, a combustion chamber, and a turbine made up of an arrangement of stators and rotors. Each of the rotors includes blades and a supporting disc. The walls of the combustion chamber, the stators, and the rotor blades all come into contact with the hot combustion gases and, due to metallurgical concerns, are unable to withstand the temperatures discussed above. As a result, conventional gas turbine engines operate at temperatures of at most only 2800 degrees Fahrenheit and utilize various cooling techniques to lower the temperature of engine parts even further. This results in low power per unit of airflow and low fuel efficiencies, relative to those possible with near-stoichiometric combustion.

Cooling of the stationary stators and combustion chamber walls by evaporative means such as are proposed here is relatively straight forward and various effective techniques are readily available. Due to the speed at which the rotors rotate, however, it is especially difficult to cool the rotor blades.

Today, many engines utilize air cooling to maintain the temperature of metal parts in the combustor and turbine substantially below that of the working fluid. For example, at the conventional operating temperatures noted above, air cooling can be utilized to limit the temperature of the rotor blades to around 1800 degrees Fahrenheit.

As stated, though, due to metallurgical concerns firing temperatures are still well below those corresponding to optimum stoichiometric conditions for combustion. Accordingly, the efficiencies and power densities attained with known engines are significantly below those which are potentially achievable with turbine inlet temperatures corresponding to stoichiometrically ideal combustion conditions.

Various approaches have been proposed for utilizing internal fluid cooling to more effectively cool engine parts such as combustion chamber walls and turbine rotors and stators. In the case of rotor blades, some approaches have involved the internal circulation of cooling fluid from the root of a rotor out through the tip of the rotor blade. Another approach has been to utilize a closed cycle cooling system in which cooling fluid occupies a portion only of an internal cavity in the blade. The physical properties of the cooling fluid are such that it is vaporized in certain regions of the internal cavity by reasons of the temperature prevailing in those regions during normal operation of the engine.

A significant problem with such closed cycle cooling of rotors is the difficulty associated with distributing the liquid phase of the cooling fluid over the walls of the internal cavity of the rotor. Without a substantially even distribution of the cooling fluid, uniform cooling of the rotor blade cannot be achieved.

It is an object of the invention, therefore, to provide an internal combustion engine in which combustion temperature is maintained at a level based on stoichiometric, rather than metallurgical, considerations for maximum performance and efficiency. It is another object of the invention to provide an internal combustion engine wherein higher combustion temperatures can be achieved while maintaining material temperatures at levels at least as low as those associated with known engines. Another object of the invention is to provide a gas turbine engine utilizing closed cycle evaporative cooling for the engine's moving parts. Still another object is to provide a rotor for use in a turbine of such an engine.

SUMMARY OF THE INVENTION

These and other objects are achieved by the present invention which in one aspect features an evaporatively cooled internal combustion engine including a compressor for compressing a working fluid and a combustion chamber in fluid communication with the compressor for containing the compressed working fluid during combustion. The engine further includes a turbine in fluid communication with the combustion chamber and formed of an arrangement of stators and rotors. Through rapid expansion, the working fluid performs work on the rotors causing them to drive a shaft in a rotating fashion.

Each of the rotors defines an internal cavity which is divided into a vaporization section disposed radially outwardly with respect to the shaft from a condensing section. The vaporization section corresponds roughly to the rotor blade while the condensing section corresponds roughly to the rotor disc. Cooling fluid occupies a portion of the internal cavity.

A significant feature of the invention is that in the vaporization section the rotor defines circumferentially disposed capture shelves for capturing cooling fluid which flows radially outwardly in a centrifugal field generated during operation of the turbine. The capture shelves restrict the flow of the cooling fluid to distribute the fluid over the internal surface of the rotor in the vaporization section.

The cooling fluid removes heat from the wall of the rotor by vaporizing. Vaporized cooling fluid flows radially inwardly against the centrifugal field by pumping action created by the difference in vapor pressures in the blade vaporization section and disc condensing section. Heat is removed from the vaporized cooling fluid, either by force or naturally, in the condensing section of the rotor causing the fluid to reliquify and join the outward flow.

In one embodiment of the invention the capture shelves form a radial array of circumferentially oriented capture shelves. Each of the shelves is formed of a lip disposed at a substantially constant radius from the rotational axis and a well adjacent the lip for capturing the flowing cooling fluid.

In this embodiment, the invention provides an evaporatively cooled internal combustion engine utilizing a closed cooling system in which cooling fluid cascades outwardly in the centrifugal field of the rotating rotors. The fluid falls from one capture shelf to another, with some fluid being evaporated at each shelf. All fluid which is evaporated passes inward as vapor to the condensing section in the rotor. There, it is reliquified and then flows back outward to the cooling cascade in the rotor blades.

These and other features of the invention will be more readily appreciated by reference to the following detailed description which is to be read in conjunction with the attached drawings.

DETAILED DESCRIPTION

As stated, in one aspect the invention features an evaporatively cooled internal combustion engine such as, for example, a gas turbine engine. In this aspect, the engine includes a turbine comprising an arrangement of stators and rotors. Each of the rotors defines a closed internal cavity in which cooling fluid occupies a portion of the volume. The physical properties of the cooling fluid are such that it is vaporized in certain regions of the internal cavity by reasons of the temperature which prevails in these regions during the normal operation of the turbine. Other portions of the rotor are subjected to either natural or forced cooling, as described in more detail below, to condense the vaporized cooling fluid.

Figure 1:
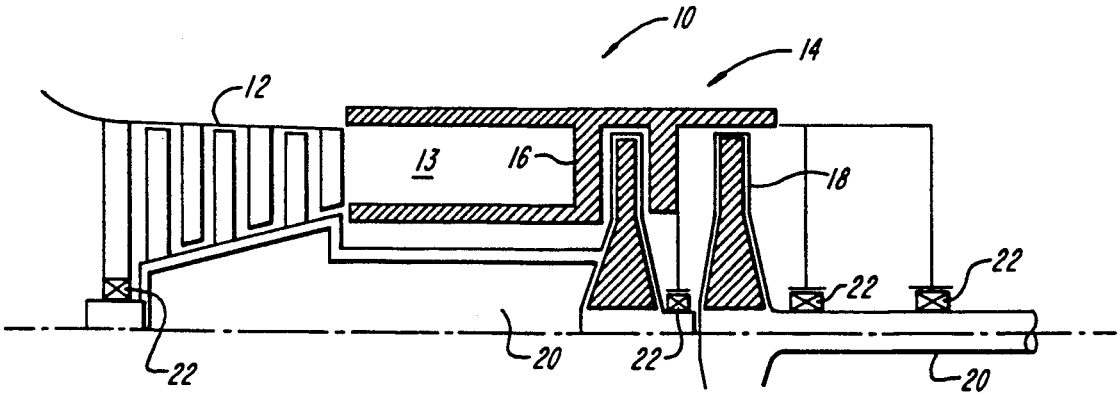
FIG. 1 is a schematic representation of part of an evaporatively cooled gas turbine engine constructed in accordance with the teachings of the present invention.

An example of a gas turbine engine constructed in accordance with the invention is shown in FIG. 1. There, an engine 10 includes a compressor 12, a combustion chamber 13, and a turbine 14. The turbine 14 comprises an arrangement of stators 16 and rotors 18. The rotors 18 drive shafts 20 which are supported in bearings 22. Through rapid expansion, working fluid exiting the combustion chamber 13 performs work on the rotors 18 causing them to drive the shafts 20.

An important feature of the invention is that the rotors 18 employ an internal cooling system by phase transition and circulation in a closed cycle of a cooling fluid. The liquid phase of the cooling fluid occupies a portion only of an internal cavity provided in the rotor. This internal cavity is more clearly shown in FIG. 2 which is a cross-section view of a typical rotor 18.

The rotor 18 is formed of a wall 32 which encloses an internal cavity 34. The internal cavity 34 is divided into a condensing section 36 at the rotor disc 28 and a vaporization section 38 at the rotor blade 26. Typically, multiple rotor blades 26 are supported by the rotor disc 28.

Cooling fluid F is contained within the internal cavity 34 for removing heat from the wall 32 at the vaporization section 38. This is because it is the blade 26 that comes into contact with engine working fluid in the form of hot products of combustion. The physical properties of the cooling fluid are such that it vaporizes at the temperatures experienced in the vaporization section 38 during normal operation of the rotor 18.

Various liquid metals such as sodium, potassium or a mixture of these are suitable for use as the cooling fluid F. Other appropriate cooling fluids will be apparent to those skilled in the art.

During operation of the engine 10, rotation of the rotor 18 generates a centrifugal field which causes cooling fluid F in liquid phase to flow in the direction of arrows 40 to the vaporization section 38. In accordance with the invention, the flowing cooling fluid is distributed over the internal surface of the wall 32 in the vaporization section 38 by the radial array of capture shelves 46 which is defined by the wall 32. The cooling fluid cascades from one capture shelf to another, with some fluid being evaporated at each shelf to remove heat from the area of the wall 32 local to the shelf. Evaporated fluid flows radially inwardly as vapor in the direction of arrows 42 to the condensing section 36 where it is reliquified. This is effected by a pumping action generated by the difference in vapor pressures in the vaporization and condensing sections of the rotor 18.

Figure 2:
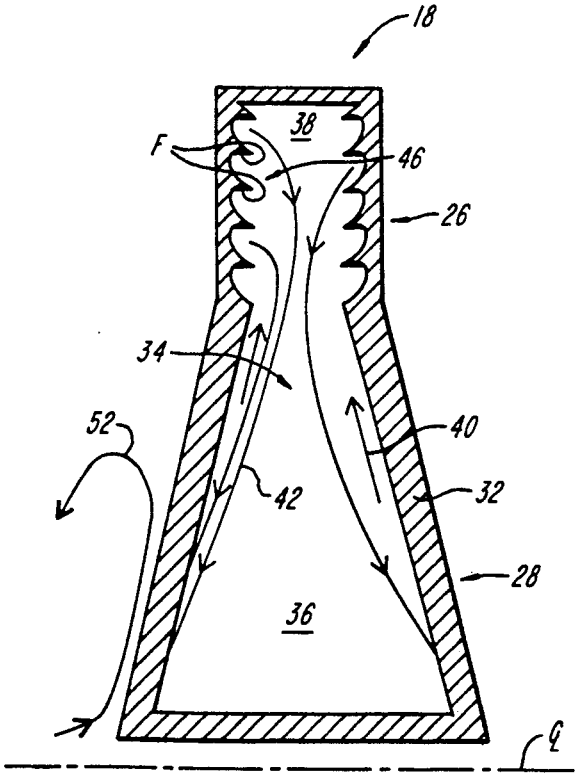
FIG. 2 is a schematic cross-section view of a rotor constructed in accordance with the teachings of the present invention.
Figure 3:
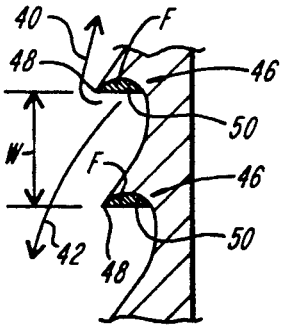
FIG. 3 is an enlarged view of a part of the rotor shown in FIG. 2.

An enlarged view of two capture shelves 46 is shown in FIG. 3. Each capture shelf 46 includes a lip 48 and a well 50. The lip 48 extends circumferentially with respect to the rotor axis of rotation. As discussed above, cooling fluid F cascades outwardly in the centrifugal field to fill the well 50 of successive capture shelves 46. As captured fluid vaporizes due to heat flux from the wall 32 to the fluid F, it returns as vapor to the condensing section 36 (FIG. 2).

Heat rejected by cooling fluid reliquifying in the condensing section 36 can be removed in any number of ways. For example, heat conducted through the wall 32 can be removed by convective cooling of the disc 28 by air or other fluid as represented by arrows 52 in FIG. 2. It is also possible to introduce a liquid cooled condenser near the axis of rotation C in the rotating system. Cooling fluid in such a system could be fed to the rotor 18 by a system of hydraulic seals which will be readily known to those skilled in the art.

An advantage of the invention is that the flow rate of the cooling fluid F is automatically controlled to be that required by the total heat load to the rotor blade 26. As long as there is enough cooling fluid to fill the capture shelves 46, variations in local heat load result only in variations in local evaporation rate. That is, increased heat load results in increased evaporation rate and increased vapor flow rate. The net result is to hold the blade 26 at a substantially constant temperature which is set by the temperature of the condensing section 36.

Increased vapor flow causes an increase in the temperature of the condensing section 36. Increases in the condensing section temperature cause an increase in the vapor pressure in the internal cavity 34. This causes an increase in blade temperature which reduces heat flow to the blade. The increase in blade temperature resulting from the increased heat load, however, is relatively small because of the very rapid increase of pressure with temperature. Accordingly, the inventive system is well adapted for handling increases in heat load to the rotor blade.

The system is also well suited for handling the problems associated with state changes such as during start up from an initially cold condition, during shut down from hot operation, and during transients from one operating condition to another. During cold start up, the cooling fluid F in the rotor 18 is in liquid form. When rotation begins, the fluid F accumulates in the upper most region of the blade 26. At this point, vapor flow is small because temperature and vapor pressure in the internal cavity 34 are low.

As the temperature of the blade 26 increases, cooling fluid F in the vaporization section 38 begins to vaporize and flow to the condensing section 36 due to the pumping action described above. Once in the condensing section 36, the cooling fluid F reliquifies and flows into the cascade in the direction of arrows 40 filling the array of capture shelves 46 successively from the radially innermost shelf 46. Eventually, vapor flow achieves steady state, all of the capture shelves contain cooling fluid, and the normal operation described above takes hold.

To avoid overheating of unfilled capture shelves during cold start up, the operating temperature of the turbine 14 should be brought up to steady state condition gradually. Shutting down of the engine should be undertaken gradually as well. This is because cooling liquid is retained in the capture shelves only as long as the rotors 18 are rotating. If the rotors stop rotating suddenly, therefore, overheating of the rotor blades could occur.

It is a significant advantage of the invention that the described closed cycle cascading cooling system reacts quickly to changes in operating condition of the engine. In fact, the reaction time is determined by the flow rate of the vapor to the condensing section and of the cascading liquid from the condensing section. Since these times are on the order of milliseconds, the response of the inventive cooling system to changes in operating condition is sufficiently fast so that the required engine starting and stopping periods are conveniently brief.

Physical requirements for the construction of a rotor suitable for use with the present invention can be determined by estimating the heat flux which must be accepted by the cooled rotor blade. That heat flux is given by the following equation.

$$q_w = \rho u c_p (T_t - T_w) St$$

where $\rho u$ is the mass flux density in the flow passage to be cooled, $c_p$ is the specific heat of the working fluid combustion products, $T_t - T_w$ is the difference between the working fluid combustion products stagnation temperature and the temperature of the cooled rotor wall, and St is the Stanton number.

For a typical gas turbine engine, therefore, where $\rho u = 500$ lb/sec·ft$^2$, $c_p = 0.24$ BTU/lb R, $T_t - T_w = 3000$ R, and $St = 0.001$, heat flux to the rotors is approximately 600 BTU/ft$^2$sec. To maintain the rotor blade at an acceptable temperature, this heat flux must be conducted through the wall of the rotor blade to the cooling fluid. The conduction process is governed by Fourier's law of heat conduction which says that $$q_w = k \frac{\Delta T}{\Delta x}$$

where K is the thermal conductivity of the blade material, $\Delta T$ is the temperature difference between the inside and the outside of the rotor wall, and $\Delta x$ is the thickness of the rotor wall.

Since the objective of the cooling system is to maintain the rotor at as nearly as possible a constant temperature, Fourier's law of heat conduction sets a limit on the permissible thickness of the rotor wall 32. For copper, for example, where $K = 0.064$ BTU/secft$^2$(R/ft), and for the above estimated heat flux, the allowable wall thickness is approximately 0.6 inches if the allowable temperature difference is 500 R. On the other hand, for a steel rotor which has a conductivity of about 1/10 that of copper, the allowable wall thickness is reduced to approximately 0.06 inches.

For the evaporation of the cooling fluid to absorb the heat of the rotor blade, heat must be conducted from all points on the blade to the immediate neighborhood of the fluid in the capture shelves. Accordingly, in addition to the thickness of the rotor wall, the spacing W (FIG. 3) of the capture shelves, is governed by the above described relationships. That is, in the case of a copper rotor W should be no greater than 0.6 inches. In the case of a steel rotor, W should not exceed 0.06 inches. An important feature of a rotor constructed in accordance with the present invention, therefore, is that the capture shelves are spaced relatively closely together, the closer the larger the heat flux.

For the cascade to function properly in the acceleration field of the rotor 18, it is necessary that the array capture shelves 46 be level in the "effective gravity" of the rotor. This ensures that each capture shelf 46 fills with cooling fluid before the fluid spills over the shelf lip 48 to the next radially outward shelf.

For this purpose, the lip 48 of each capture shelf 46 should circumferentially extend at a substantially constant radius from the axis of rotation C over the entire internal circumference of the rotor 18. While some deviation from this requirement can be tolerated, it should be small compared to the spacing between shelves.

Another requirement for the proper operation of the inventive cooling system is that disturbances of the rotational force field, by either gravity or by rotational or lateral acceleration of the entire engine, be small compared to the centrifugal field generated by the rotating rotor. As described below, due to the intensity of the generated centrifugal field, this condition is well met.

The centripetal acceleration of the rotor is $v^2/r$, where v is the tangential velocity of the rotor blade and r is the radius. For a typical value of $v = 1000$ ft/sec or more and a 1 foot radius, this acceleration is $10^6$ ft/sec$^2$. This is about $3 \times 10^4$ times greater than the acceleration of gravity. It is clear then that gravity itself introduces only minor perturbations to the centrifugal field. Moreover, the system is insensitive to lateral accelerations as high as 100 times greater than gravity. Still further, if the rotor takes a one second acceleration period to reach steady state of velocity, the equivalent peripheral acceleration of the blade is on the order of $10^3$ ft/sec$^2$. This is still a factor of thirty times less than the acceleration due to the steady state rotation and has little effect on the cooling fluid cascade.

Accordingly, the invention provides a closed cycle cooling system for evaporatively cooling moving parts of an internal combustion engine such as turbine rotors. The system distributes cooling fluid evenly over the inner surface of the blade portion of a rotor blades which come into contact with hot working fluid products of combustion. In accordance with the invention, therefore, combustion chamber conditions in a gas turbine engine, for example, can be stoichiometrically determined to optimize engine performance rather than metallurgically determined to minimize engine wear.

It should be understood that the above description of the invention is intended for purposes of illustration only and that various alterations will be apparent to those skilled in the art. The invention is to be defined, therefore, not by the preceding description but by the claims that follow.

What is claimed is:

1. An evaporatively cooled rotor adapted for rotation about a rotational axis and having an internal cavity including a vaporization section disposed radially outwardly with respect to the rotational axis from a condensing section, the rotor further comprising at least one capture means in the vaporization section disposed at a substantially constant radius from the rotational axis for capturing cooling fluid contained within the internal cavity and flowing radially outwardly in a centrifugal field generated during rotation of the rotor, the capture means restricting the flow of the cooling fluid to distribute cooling fluid over the inner surface of the rotor in the vaporization section.

2. A rotor as set forth in claim 1, wherein the capture means further comprises a radial array of capture shelves, each of the shelves including a lip disposed at a substantially constant radius from the rotational axis, and a well portion adjacent the lip for capturing the flowing cooling fluid.

3. A rotor as set forth in claim 2 wherein the lip of each capture shelf in the array is disposed at a radius from the rotational axis which is successively greater than the radius at which the lip of the preceding shelf is disposed.

4. An evaporatively cooled rotor for rotating about a rotational axis and having an internal cavity including a vaporization section disposed radially outwardly with respect to the rotational axis from a condensing section, the vaporization section further comprising a radial array of capture shelves each of which includes a lip disposed at a substantially constant radius from the rotational axis, and a well adjacent the lip for capturing fluid which cascades radially outwardly from the condenser section of the blade to the vaporization section.

5. A rotor as set forth in claim 4 wherein the lip of each capture shelf in the array is disposed at a radius from the rotational axis which is successively greater than the radius at which the lip of the preceding shelf is disposed.

6. An evaporatively cooled internal combustion engine comprising a compressor for compressing a working fluid, a combustion chamber in fluid communication with the compressor for receiving compressed working fluid from the compressor and containing the compressed working fluid during combustion, a turbine in fluid communication with the combustion chamber for transmitting work performed by the combusted working fluid, the turbine including an arrangement of stators and rotors, each of the rotors being adapted for rotating about an axis and having an internal cavity including a vaporization section disposed radially outwardly with respect to the rotational axis from a condensing section, each of the rotors further comprising capture means in the vaporization section disposed at a substantially constant radius from the rotational axis for capturing cooling fluid contained within the internal cavity and flowing radially outwardly in a centrifugal field generated during rotation of the rotor, the capture means restricting the flow of the cooling fluid to distribute cooling fluid over the inner surface of the rotor in the vaporization section.

7. An internal combustion engine as set forth in claim 6 wherein the engine is a gas turbine engine.

8. A gas turbine engine as set forth in claim 7 wherein the capture means comprises a radial array of capture shelves, each of the shelves including a lip disposed at a substantially constant radius from the rotational axis, and a well portion adjacent the lip for capturing the flowing cooling fluid.

9. A gas turbine engine as set forth in 8 wherein each capture shelf in the array includes a lip which is disposed at a radius from the rotational axis which is successively greater than the radius at which the lip of the preceding shelf is disposed.

* * * * *